US011286930B2

(12) United States Patent
Yamashita et al.

(10) Patent No.: US 11,286,930 B2
(45) Date of Patent: Mar. 29, 2022

(54) SCROLL COMPRESSOR HAVING RECESSED OUTER FIXED SCROLL WALL

(71) Applicant: KABUSHIKI KAISHA TOYOTA JIDOSHOKKI, Kariya (JP)

(72) Inventors: Takuro Yamashita, Kariya (JP); Shinji Tsubai, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 97 days.

(21) Appl. No.: 16/365,940

(22) Filed: Mar. 27, 2019

(65) Prior Publication Data

US 2019/0301461 A1 Oct. 3, 2019

(30) Foreign Application Priority Data

Mar. 30, 2018 (JP) ..... JP2018-070074

(51) Int. Cl.
*F04C 18/02* (2006.01)
*F04C 27/00* (2006.01)
(Continued)

(52) U.S. Cl.
CPC ..... *F04C 18/0215* (2013.01); *F04C 18/0253* (2013.01); *F04C 27/005* (2013.01);
(Continued)

(58) Field of Classification Search
CPC ..... F04C 18/0215; F04C 27/005; F04C 18/0253; F04C 29/0021; F04C 2240/30;
(Continued)

(56) References Cited

U.S. PATENT DOCUMENTS

2009/0317276 A1 12/2009 Lee et al.
2014/0134032 A1 5/2014 Tozawa et al.
(Continued)

FOREIGN PATENT DOCUMENTS

CN 101109634 A 1/2008
EP 2 667 029 A1 11/2013
(Continued)

OTHER PUBLICATIONS

Third party observation dated Apr. 12, 2021, from the Korean Patent office in application No. 10-2019-0035187.
(Continued)

*Primary Examiner* — Mary Davis
*Assistant Examiner* — Paul W Thiede
(74) *Attorney, Agent, or Firm* — Sughrue Mion, PLLC

(57) ABSTRACT

A scroll compressor includes a housing and a compression mechanism accommodated in the housing. The housing includes a first housing member having an annular partition wall and a second housing member. The partition wall includes a fastened portion that is thicker than other portions in a circumferential direction of the partition wall. The compression mechanism includes a fixed scroll member and an orbiting scroll member. The fixed scroll member includes a fixed spiral wall extending spirally and an outer circumferential wall that surrounds the fixed spiral wall. The outer circumferential wall includes a recess forming portion having a recess recessed inward in the radial direction. The recess is located at a part of the outer circumferential wall opposed to the fastened portion in the radial direction.

4 Claims, 4 Drawing Sheets

(51) Int. Cl.
*F04C 29/00* (2006.01)
*F04C 29/12* (2006.01)

(52) U.S. Cl.
CPC ..... *F04C 29/0021* (2013.01); *F04C 29/00* (2013.01); *F04C 29/12* (2013.01); *F04C 2240/30* (2013.01)

(58) Field of Classification Search
CPC .. F04C 29/12; F04C 2240/10; F04C 18/0261; F04C 29/00
See application file for complete search history.

(56) References Cited

U.S. PATENT DOCUMENTS

| | | | | |
|---|---|---|---|---|
| 2014/0178232 | A1* | 6/2014 | Nagano | F04C 29/028 418/55.6 |
| 2014/0248172 | A1* | 9/2014 | Nagano | F01C 19/005 418/55.4 |
| 2016/0108915 | A1* | 4/2016 | Deguchi | F04C 18/0215 418/55.2 |

FOREIGN PATENT DOCUMENTS

| | | | |
|---|---|---|---|
| JP | 2012-149572 | A | 8/2012 |
| JP | 2014-231750 | A | 12/2014 |
| JP | 2017-25731 | A | 2/2017 |
| KR | 10-0672283 | B1 | 1/2007 |
| KR | 10-2014-0061254 | A | 5/2014 |
| WO | 2017/108572 | A1 | 6/2017 |

OTHER PUBLICATIONS

Third party observation dated Oct. 20, 2020, from the Korean Patent office in application No. 10-2019-0035187.

Third Party Observation dated Feb. 14, 2020, from the Korean Patent Office in application No. 10-2019-0035187.

"Toyota Industries Report", Toyota Industries Corporation, Mar. 31, 2017, pp. 1-89 (47 pages total).

"Toyota Industries Exhibits ESBG27 Electric Compressor with Gas Injection Function on Toyota Industries, Toyota Prius PHV [Japan]", MarkLines, Human and Kuruma Technology Exhibition 2017 Yokohama, May 25, 2017, (1 page total).

Prius PHV "Heat Pump Auto Air Conditioner With Gas Injection Function" [Automotive Engineering Exposition], Rakuten Infoseek News, May 30, 2017 (3 pages total).

"Toyota: Prius PHV's Heating System Recompresses Coolant" Technology, Japan Bullet, Mar. 7, 2017, (1 page total).

"Heat Pump Auto Air Conditioner With Gas Injection Function" https://clicccar.com/2017/05/30/477221/img_1582/; May 30, 2017, (1 page total).

* cited by examiner

SCROLL COMPRESSOR HAVING RECESSED OUTER FIXED SCROLL WALL

BACKGROUND

The present disclosure relates to a scroll compressor.

Japanese Laid-Open Patent Publication No. 2012-149572 discloses a scroll compressor provided with a fixed scroll member and an orbiting scroll member. The fixed scroll member and the orbiting scroll member each include a spiral wall. The compressor is configured such that orbiting motion of the orbiting scroll member with the two spiral walls engaged with each other causes fluid to be compressed between the two spiral walls.

The compressor includes a housing that accommodates the fixed scroll member and the orbiting scroll member. The housing includes a compression mechanism housing block and an electric motor housing block that are fastened to each other by fasteners.

More specifically, bolts serving as the fasteners are fastened to threaded holes of the electric motor housing block with the bolts inserted into bolt through-holes of the compression mechanism housing block.

SUMMARY

Protruding a fastened portion having the bolt through-holes into the space in the housing helps reduce the scroll compressor in size. However, when the distance between the outer circumferential wall of the fixed scroll member and the fastened portion protruding into the space is small, the flow of fluid in the space in the housing may be limited.

A scroll compressor that solves the above-described problem includes a housing having a suction port and a discharge port and a compression mechanism accommodated in the housing. The compression mechanism is configured to compress fluid drawn in from the suction port and discharge the fluid out of the discharge port. The housing includes a first housing member having an annular partition wall and a second housing member fastened to the first housing member by a fastener. The first housing member and the second housing member internally define a space. The partition wall includes a fastened portion through which the fastener is inserted. The fastened portion is thicker than other portions in a circumferential direction of the partition wall. The fastened portion protrudes inward in a radial direction in the space. The compression mechanism includes a fixed scroll member accommodated in the space and an orbiting scroll member accommodated in the space. The orbiting scroll member is engaged with the fixed scroll member to define a compression chamber. The fixed scroll member includes a fixed spiral wall extending spirally and an outer circumferential wall that surrounds the fixed spiral wall. The outer circumferential wall includes a recess forming portion having a recess recessed inward in the radial direction. The recess is located at a part of the outer circumferential wall opposed to the fastened portion in the radial direction.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the presently preferable embodiments together with the accompanying drawings in which.

DETAILED DESCRIPTION

A scroll compressor 10 according to an embodiment will now be described.

First, the overview of the scroll compressor 10 will be described.

Figure 1:
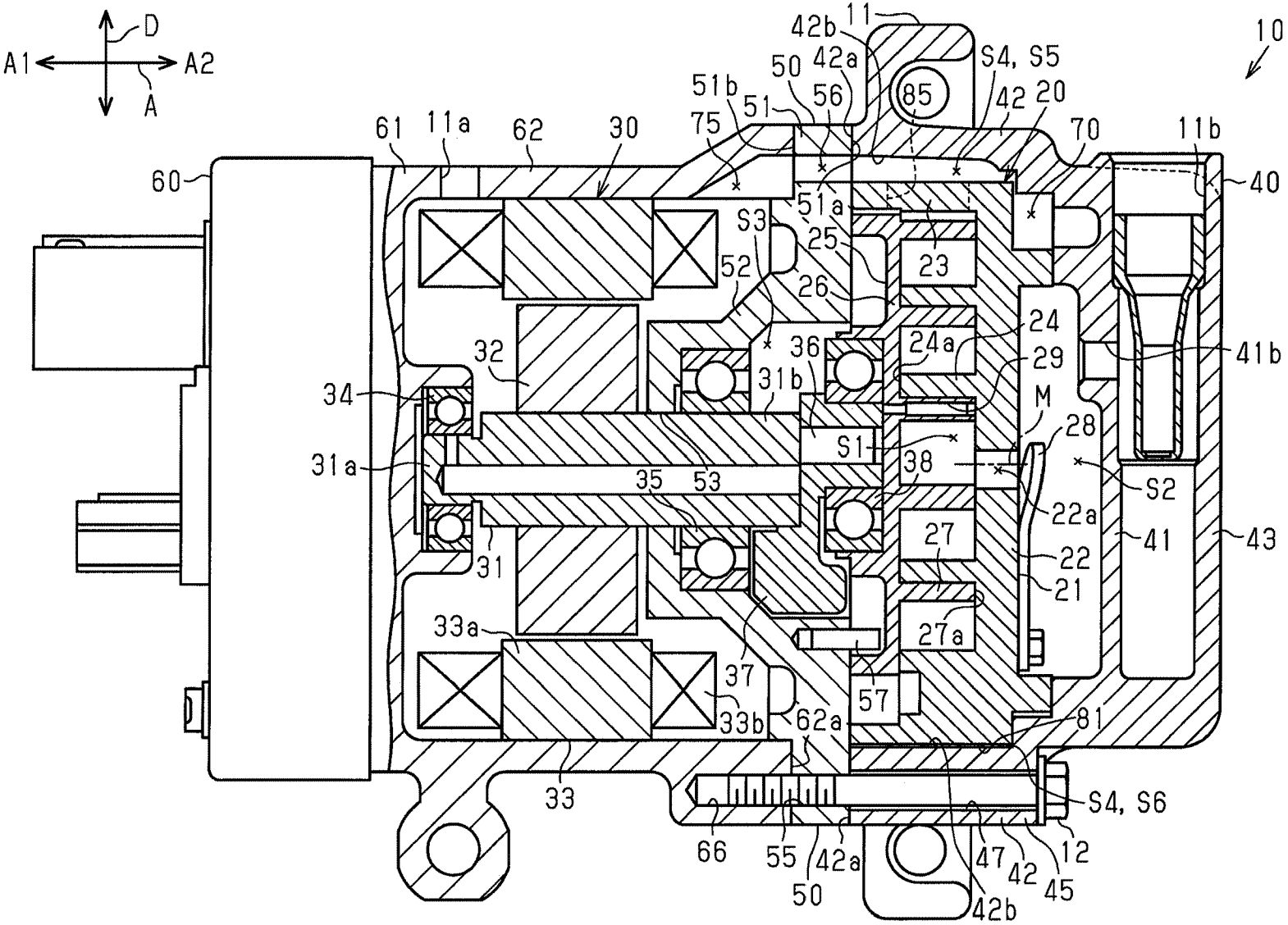
FIG. 1 is a cross-sectional view taken along line I-I in FIG. 2.

Referring to FIG. 1, the scroll compressor 10 is installed in a vehicle (not shown) and used for an onboard air conditioner (not shown). The scroll compressor is hereinafter simply referred to as the compressor. The fluid to be compressed by the compressor 10 is, for example, refrigerant. Refrigerant contains oil.

The compressor 10 includes a housing 11. The housing 11 is hollow and substantially cylindrical as a whole. The housing 11 includes a suction port 11*a* into which fluid is drawn and a discharge port 11*b* out of which the fluid is discharged.

The compressor 10 includes a compression mechanism 20 and an electric motor 30. The compression mechanism 20 compresses fluid drawn in from the suction port 11*a* and discharges the fluid out of the discharge port 11*b*. The electric motor 30 is one example of a driving mechanism that drives the compression mechanism 20. The compression mechanism 20 and the electric motor 30 are accommodated in the housing 11.

The compression mechanism 20 includes a fixed scroll member 21 having a fixed spiral wall 24 and an orbiting scroll member 25 having an orbiting spiral wall 27. The compression mechanism 20 is configured such that orbiting motion of the orbiting scroll member 25 with the fixed spiral wall 24 and the orbiting spiral wall 27 engaged with each other causes fluid to be compressed between the fixed spiral wall 24 and the orbiting spiral wall 27. The compression mechanism 20 will be described in detail later.

In the following description, the direction along the center line M of the orbiting spiral wall 27, which extends spirally, is referred to as an axial direction A. One side (left side in FIG. 1) of the compressor 10 or its components with respect to the axial direction A is referred to as a first side A1, and the other side (right side in FIG. 1) of the compressor 10 or its components with respect to the axial direction A is referred to as a second side A2. The direction orthogonal to the center line M is referred to as a radial direction D. The end of the compressor 10 or its components on the first side A1 is referred to as a first end, and the end of the compressor 10 or its components on the second side A2 is referred to as a second end.

The compressor 10 will now be described in detail.

The housing 11 includes an annular first housing member 40 with the second end closed, a circular second housing member 50, and an annular third housing member 60 with the first end closed. The first housing member 40 and the third housing member 60 are fastened to each other using bolts 12, which serve as fasteners, with the open ends of the first housing member 40 and the third housing member 60 respectively in abutment with the opposite surfaces of the second housing member 50.

Figure 2:
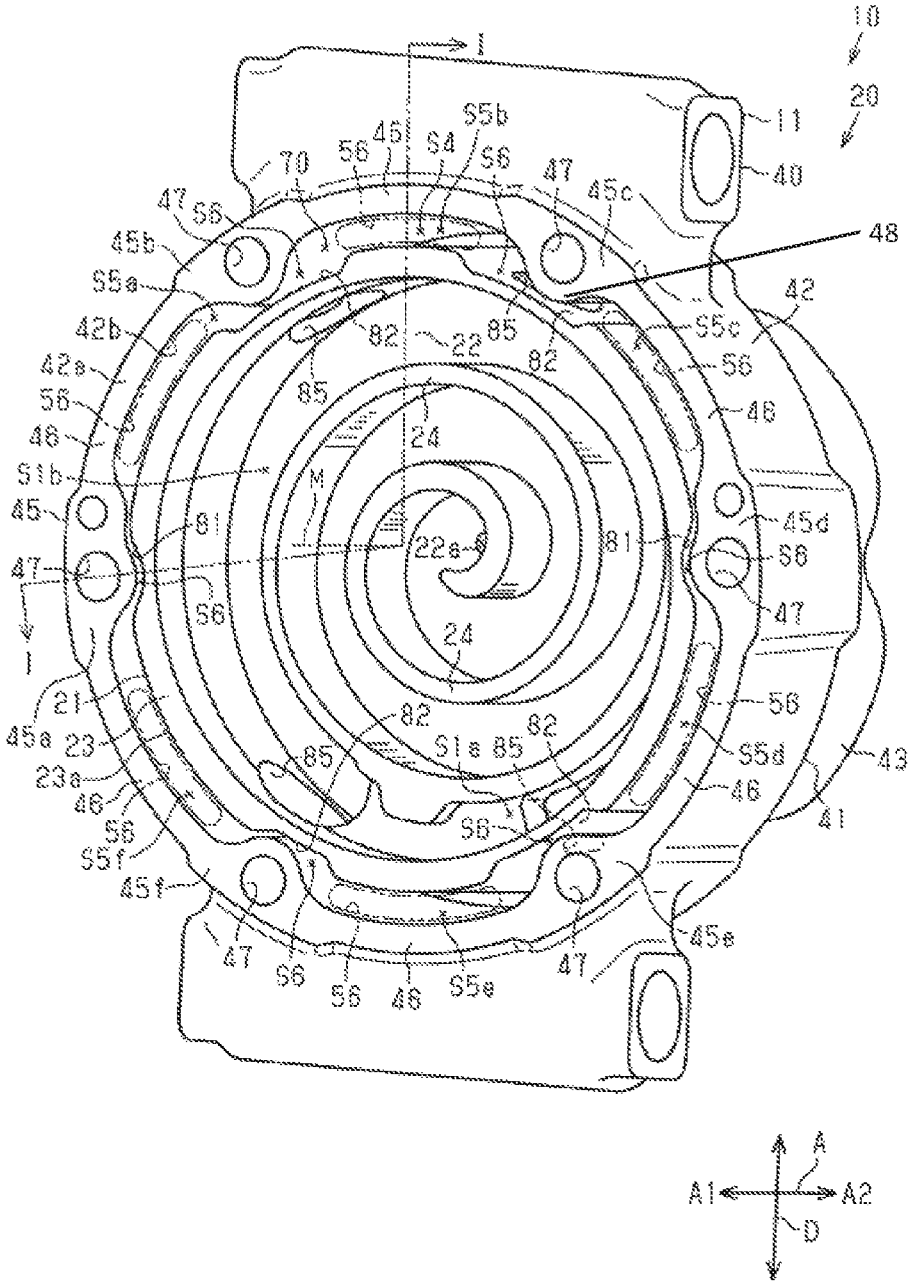
FIG. 2 is a perspective view showing part of a scroll compressor according to an embodiment.

As shown in FIGS. 1 and 2, the first housing member 40 includes a circular first end plate 41 intersecting the axial direction A and a first circumferential wall 42 extending cylindrically from the edge of the first end plate 41 toward the first side A1. The first circumferential wall 42 is one example of an annular partition wall. The first housing member 40 includes an oil separator 43. The oil separator 43 is formed on the surface on the second side A2 of the first end plate 41 and disposed between the closed second end of the first housing member 40 and the first end plate 41. The first end plate 41 includes a discharge passage 41*b* extending through the first end plate 41 in the axial direction A. The space located closer to the first side A1 than the first end plate 41 and the space in the oil separator 43 communicate with each other through the discharge passage 41*b*. The discharge port 11*b* is formed in the oil separator 43.

The first circumferential wall 42 includes a first end surface 42*a* located on the first side A1 and an inner circumferential surface 42*b* continuous with the first end surface 42*a*. The first circumferential wall 42 includes thick portions 45, each having a first thickness as the dimension in the radial direction D, and thin portions 46, each having a second thickness as the dimension in the radial direction D. The second thickness is smaller than the first thickness. That is, the thick portions 45 are thicker portions than other portions in the circumferential direction.

The thick portions 45 includes a first thick portion 45*a*, a second thick portion 45*b*, a third thick portion 45*c*, a fourth thick portion 45*d*, a fifth thick portion 45*e*, and a sixth thick portion 45*f*. The first to sixth thick portions 45*a* to 45*f* are arranged in this order in the clockwise direction as viewed from the first side A1 at equal intervals in the circumferential direction of the first circumferential wall 42. The first thick portion 45*a* and the fourth thick portion 45*d* are located on the opposite sides in the radial direction D. The second thick portion 45*b* and the fifth thick portion 45*e* are located on the opposite sides in the radial direction D. The third thick portion 45*c* and the sixth thick portion 45*f* are located on the opposite sides in the radial direction D.

In the thick portions 45, the inner circumferential surface 42*b* of the first circumferential wall 42 protrudes inward in the radial direction D from each thin portion 46 located between two of the thick portions 45, which are arranged in the circumferential direction. In the thick portions 45, the outer circumferential surface of the first circumferential wall 42 protrudes outward in the radial direction D from each thin portion 46 located between two of the thick portions 45, which are arranged in the circumferential direction. In the thick portions 45, the dimension of the inner circumferential surface 42*b* that protrudes inward in the radial direction is greater than the dimension of the outer circumferential surface that protrudes outward in the radial direction.

The first housing member 40 includes bolt through-holes 47, each extending through the corresponding thick portion 45 in the axial direction A. The first housing member 40 includes six bolt through-holes 47 that respectively correspond to the thick portions 45. The shafts of the bolts 12 are inserted through the bolt through-holes 47.

As shown in FIG. 1, the second housing member 50 is held between the first housing member 40 and the third housing member 60. The second housing member 50 includes a partition wall 51 having the shape of an annular plate and a support 52 protruding from the inner edge of the partition wall 51 in the radial direction toward the first side A1. The support 52 includes a circular protruding end and an extending wall that extends between the protruding end and the partition wall 51. The support 52 includes a shaft hole 53 extending through the center of the protruding end in the axial direction A. The second housing member 50 includes a rotation restriction portion 57 that restricts rotation of the orbiting scroll member 25 while permitting orbiting motion of the orbiting scroll member 25.

Figure 4:
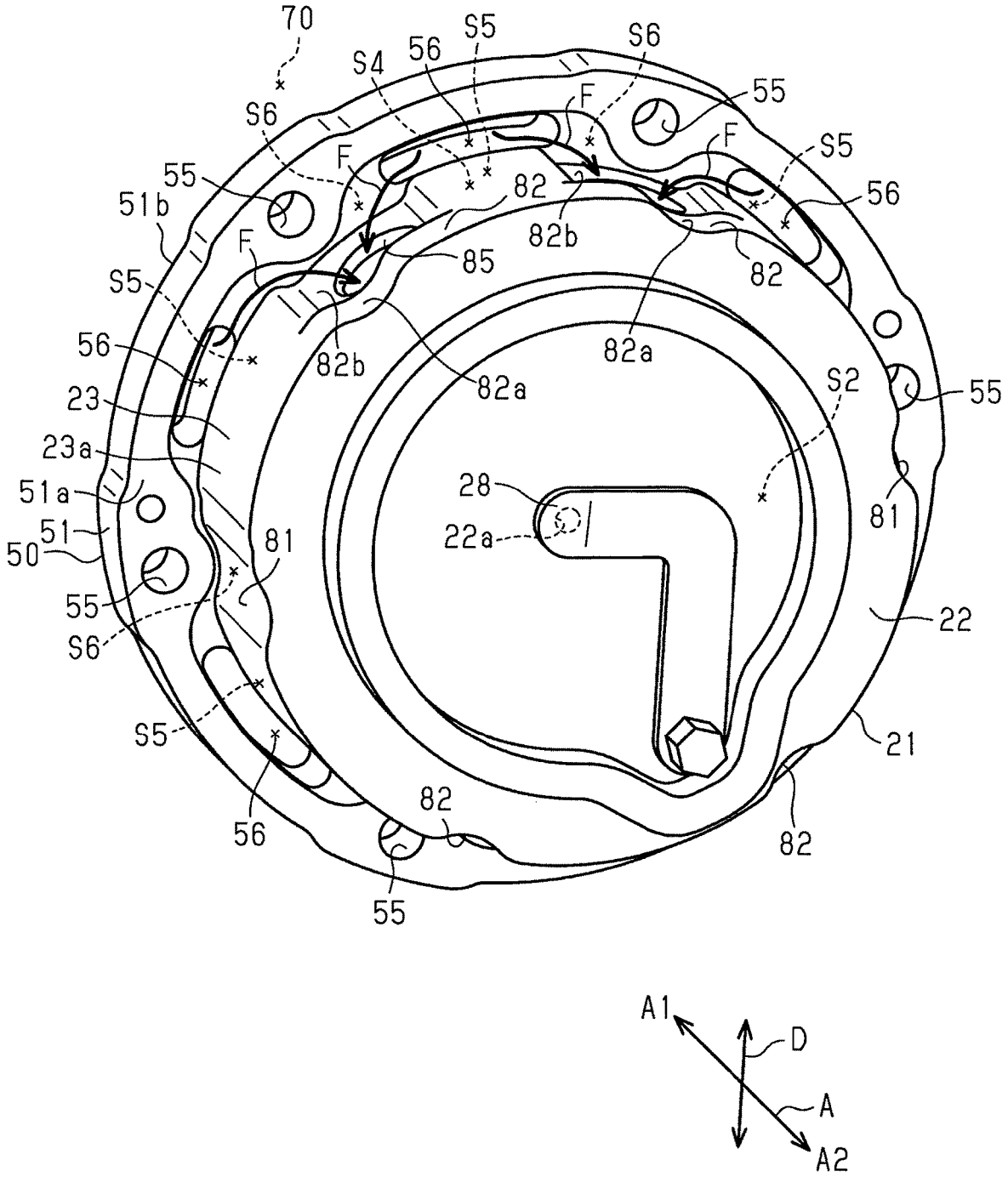
FIG. 4 is a perspective view of the fixed scroll member and a second housing member of the scroll compressor shown in FIG. 2.

As shown in FIGS. 1 and 4, the partition wall 51 includes a first partition wall surface 51*a*, which is an end surface on the second side A2, and a second partition wall surface 51*b*, which is an end surface on the first side A1. The second housing member 50 has bolt through-holes 55 extending through the edge of the partition wall 51 in the axial direction A. The second housing member 50 has the same number of the bolt through-holes 55 as the bolt through-holes 47. The bolt through-holes 55 are arranged at equal intervals in the circumferential direction of the partition wall 51.

The partition wall 51 includes suction passages 56 extending through the edge of the partition wall 51 in the axial direction A. In the present embodiment, the partition wall 51 includes multiple suction passages 56. Each suction passage 56 is an elongated hole extending in the circumferential direction between two of the bolt through-holes 55, which are arranged in the circumferential direction. The two spaces arranged in the axial direction A between which the partition wall 51 is located communicate with each other through the suction passages 56.

As shown in FIG. 1, the third housing member 60 includes a circular second end plate 61 intersecting the axial direction A and a second circumferential wall 62 extending from the edge of the second end plate 61 toward the second side A2. The second circumferential wall 62 includes a second end surface 62*a* on the second side A2. The second circumferential wall 62 has the suction port 11*a*.

The second circumferential wall 62 has bolt holes 66, which are threaded holes to which the bolts 12 are fastened. The bolt holes 66 open in the second end surface 62*a* of the second circumferential wall 62 and extend in the axial direction A. The third housing member 60 has the same number of the bolt holes 66 as the bolt through-holes 47. The bolt holes 66 are arranged at equal intervals in the circumferential direction of the second circumferential wall 62.

In the housing 11, the bolts 12 are fastened to the bolt holes 66 of the third housing member 60 with the bolts 12 inserted through the bolt through-holes 47 of the first housing member 40 and the bolt through-holes 55 of the second housing member 50. As described above, the first housing member 40 and the third housing member 60 are fastened to each other by the six bolts 12 with the second housing member 50 located in between.

The first end surface 42*a* of the first housing member 40 is in abutment with the first partition wall surface 51*a* of the second housing member 50. The second end surface 62*a* of the third housing member 60 is in abutment with the second partition wall surface 51*b* of the second housing member 50. In the present embodiment, the thick portions 45 correspond to fastened portions through which the bolts 12 are inserted and that are thicker than other portions in the circumferential direction.

The first housing member 40 and the second housing member 50 define a first accommodation space 70 in the housing 11. The first accommodation space 70 accommodates the compression mechanism 20. That is, the first accommodation space 70 is an accommodation chamber for the compression mechanism 20.

The second housing member 50 and the third housing member 60 define a second accommodation space 75 in the housing 11. The second accommodation space 75 accommodates the electric motor 30. That is, the second accommodation space 75 is an accommodation chamber for the electric motor 30.

The electric motor 30 includes a rotation shaft 31, a rotor 32, and a stator 33.

In the present embodiment, the axial direction of the rotation shaft 31 coincides with the axial direction A, and the radial direction of the rotation shaft 31 coincides with the radial direction D. The rotation shaft 31 is rotationally supported by a first radial bearing 34 and a second radial bearing 35 in the second accommodation space 75.

The first radial bearing 34 is supported by the second end plate 61 of the third housing member 60. The first radial bearing 34 supports a first end portion 31*a* of the rotation shaft 31. The second radial bearing 35 is supported by the protruding end of the support 52 so as to surround the shaft hole 53 of the second housing member 50. The second radial bearing 35 supports a second end portion 31*b* of the rotation shaft 31. The second end portion 31*b* of the rotation shaft 31 extends through the shaft hole 53 and protrudes into the first accommodation space 70.

The rotation shaft 31 includes an eccentric shaft 36 extending from the second end portion 31*b* toward the second side A2. The eccentric shaft 36 is fixed at a position deviated from the axis of the rotation shaft 31 in the radial direction D. That is, the eccentric shaft 36 is eccentric with respect to the axis of the rotation shaft 31.

The rotor 32 is fixed to the rotation shaft 31. The rotor 32 rotates integrally with the rotation shaft 31. The stator 33 is fixed to the inner circumferential surface of the third housing member 60 so as to surround the rotor 32 from the outer side in the radial direction D. The stator 33 includes a stator core 33*a* opposed to the rotor 32 in the radial direction D and a coil 33*b* wound around the stator core 33*a*.

As shown in FIG. 1, the compression mechanism 20 includes the fixed scroll member 21 and the orbiting scroll member 25. The fixed scroll member 21 and the orbiting scroll member 25 are accommodated in the first accommodation space 70. The fixed scroll member 21 is fixed to the first housing member 40. The orbiting scroll member 25 is supported in the housing member 40 in a manner that allows the orbiting scroll member 25 to orbit with respect to the fixed scroll member 21.

Figure 3:
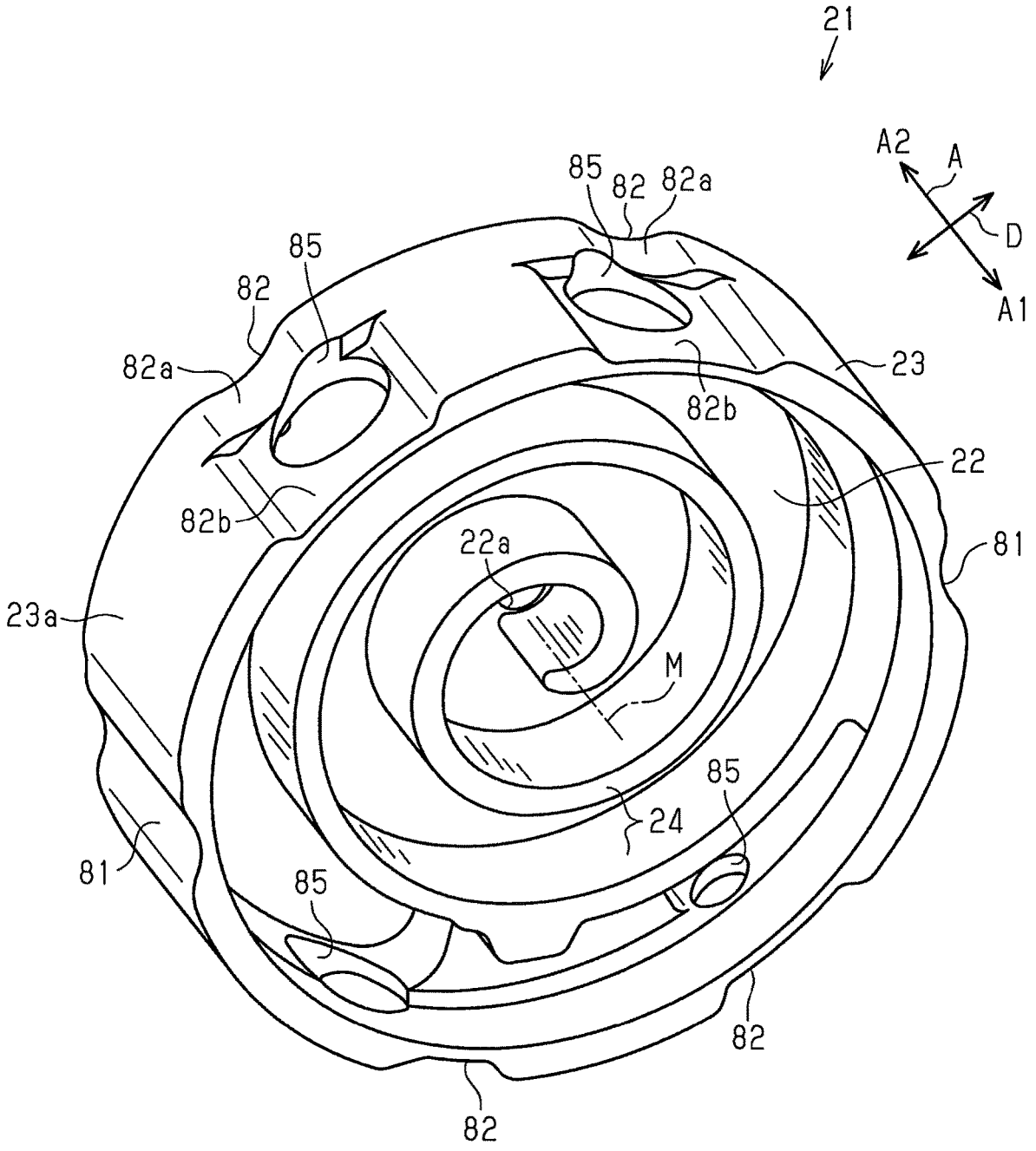
FIG. 3 is a perspective view of a fixed scroll member of the scroll compressor shown in FIG. 2.

As shown in FIGS. 1 to 3, the fixed scroll member 21 includes a circular fixed base 22 arranged on the axis of the rotation shaft 31, an outer circumferential wall 23 extending from the edge of the fixed base 22 toward the first side A1, and the fixed spiral wall 24 extending from the fixed base 22 toward the first side A1. The outer circumferential wall 23 surrounds the fixed spiral wall 24 from the outer side in the radial direction D. The fixed spiral wall 24 extends spirally from the outer circumferential portion of the fixed base 22 toward a central portion of the fixed base 22.

The fixed base 22 has a discharge port 22*a*, which is a hole extending through the fixed base 22 in the axial direction A. For example, the discharge port 22*a* is located at the center of the fixed base 22. The fixed base 22 may have multiple discharge ports.

As shown in FIGS. 1 and 4, the fixed scroll member 21 includes a discharge valve 28 that covers the discharge port 22*a*. The discharge valve 28 is coupled to an end surface of the fixed scroll member 21 located on the second side A2 of the fixed base 22. The discharge valve 28 is fixed to the fixed base 22 using fixing members such as bolts.

As shown in FIG. 1, the orbiting scroll member 25 includes a circular orbiting base 26 arranged on the axis of the rotation shaft 31 and the orbiting spiral wall 27 extending from the orbiting base 26 toward the second side A2. The orbiting base 26 is opposed to the fixed base 22 of the fixed scroll member 21. The orbiting spiral wall 27 extends spirally from the outer circumferential portion of the orbiting base 26 toward a central portion of the orbiting base 26. The orbiting scroll member 25 includes a back pressure adjustment hole 29 extending through the orbiting base 26 and the orbiting spiral wall 27 in the axial direction A.

The fixed spiral wall 24 and the orbiting spiral wall 27 are engaged with each other. The orbiting spiral wall 27 includes a distal end surface 27*a* that is in contact with or is opposed to the fixed base 22 of the fixed scroll member 21. The fixed spiral wall 24 includes a distal end surface 24*a* that is in contact with or is opposed to the orbiting base 26 of the orbiting scroll member 25.

In the housing 11, a compression chamber S1 is defined by the fixed base 22 and the fixed spiral wall 24 of the fixed scroll member 21 and by the orbiting base 26 and the orbiting spiral wall 27 of the orbiting scroll member 25. In the housing 11, a discharge chamber S2 is defined by the first end plate 41 of the first housing member 40 and the fixed base 22 of the fixed scroll member 21. The compression chamber S1 communicates with the discharge chamber S2 through the discharge port 22*a*. The discharge chamber S2 communicates with the inside of the oil separator 43 through the discharge passage 41*b*.

The orbiting base 26 of the orbiting scroll member 25 and the second housing member 50 define a back pressure chamber S3 in the housing 11. In the housing 11, the back pressure chamber S3 is located on the opposite side of the fixed base 22 with respect to the orbiting base 26. The back pressure adjustment hole 29 opens in the back pressure chamber S3. Fluid that presses the orbiting scroll member 25 toward the fixed base 22 is drawn in through the back pressure adjustment hole 29.

In the back pressure chamber S3, a bushing 37 and a bearing 38 are arranged in addition to the second end portion 31*b* of the rotation shaft 31, the eccentric shaft 36, and the second radial bearing 35. The bushing 37 is fixed to the eccentric shaft 36. The bearing 38 is fixed to an end surface of the orbiting base 26 of the orbiting scroll member 25 located on the first side A1. The bushing 37 is coupled to the bearing 38.

In the housing 11, an intake chamber S4 is defined by the first end plate 41 and the first circumferential wall 42 of the first housing member 40, the outer circumferential wall 23 of the fixed scroll member 21, and the second housing member 50. The second accommodation space 75 communicates with the intake chamber S4 through the suction passages 56 of the second housing member 50.

The structure of the outer circumferential wall 23 of the fixed scroll member 21 will now be described in detail.

As shown in FIG. 2, the intake chamber S4 is a space surrounded in the axial direction A by the first end plate 41 of the first housing member 40 and the partition wall 51 of the second housing member 50. Further, the intake chamber S4 is a space surrounded in the radial direction D by the first circumferential wall 42 of the first housing member 40 and the outer circumferential wall 23 of the fixed scroll member 21. That is, the intake chamber S4 is a space surrounding the outer circumferential wall 23 in the radial direction D.

The inner circumferential surface 42*b* of the first circumferential wall 42 protrudes inward in the radial direction D from the thin portions 46 of the first circumferential wall 42 in the thick portions 45. That is, the thick portions 45 protrude toward the outer circumferential wall 23 of the fixed scroll member 21.

Thus, the intake chamber S4 is divided into intake sub-chambers S5 by the thick portions 45, which protrude into the intake chamber S4. More specifically, the intake chamber S4 of the present embodiment is divided by the first to sixth thick portions 45*a* to 45*f* into first to sixth intake sub-chambers S5*a* to S5*f*.

As shown by the long dashed double-short dashed line in FIG. 2, the suction passages 56 of the second housing member 50 open respectively in the first to sixth intake sub-chambers S5*a* to S5*f*. Two of the intake sub-chambers S5 arranged in the circumferential direction of the first circumferential wall 42 with one of the thick portions 45 located in between communicate with each other through a connection space S6.

As shown in FIGS. 2 and 3, the fixed scroll member 21 includes first recesses 81 recessed inward in the radial direction D. The first recesses 81 are located in the radial direction D at the part of an outer circumferential surface 23*a* of the outer circumferential wall 23 opposed to the first thick portion 45*a* and at the part of the outer circumferential surface 23*a* opposed to the fourth thick portion 45*d*. Each first recess 81 extends from the end (distal end) on the first side A1 of the outer circumferential wall 23 toward the end (basal end) on the second side A2.

Each first recess 81 is curved along the corresponding thick portion 45, which is opposed to the first recess 81. The distance between the outer circumferential surface 23*a* of the outer circumferential wall 23 and the inner circumferential surface 42*b* of the first circumferential wall 42 in each first recess 81 is referred to as a first distance.

The fixed scroll member 21 includes second recesses 82 recessed inward in the radial direction D. The second recesses 82 are located in the radial direction D at the part of the outer circumferential surface 23*a* of the outer circumferential wall 23 opposed to the second thick portion 45*b*, the part of the outer circumferential surface 23*a* opposed to the third thick portion 45*c*, the part of the outer circumferential surface 23*a* opposed to the fifth thick portion 45*e*, and the part of the outer circumferential surface 23*a* opposed to the sixth thick portion 45*f*. That is, the second recesses 82 are arranged at four of the six parts of the outer circumferential surface 23*a* of the outer circumferential wall 23 that are opposed to the thick portions 45. Each second recess 82 extends from the end (distal end) of the first side A1 of the outer circumferential wall 23 toward the end (basal end) of the second side A2. A tip 48 of the respective thick portions 45 protrudes into the respective second recesses 82.

As shown in FIGS. 3 and 4, each second recess 82 includes a basal recess 82*a* located on the second side A2 of the outer circumferential wall 23 and a distal recess 82*b* located on the first side A1 of the outer circumferential wall 23. Each basal recess 82*a* is curved along the corresponding thick portion 45, to which the basal recess 82*a* is opposed. The distance between the outer circumferential surface 23*a* of the outer circumferential wall 23 and the inner circumferential surface 42*b* of the first circumferential wall 42 in each basal recess 82*a* is referred to as a second distance.

Each distal recess 82*b* is further curved and widened in the circumferential direction than the corresponding thick portion 45, to which the distal recess 82*b* is opposed. Each distal recess 82*b* is shaped differently from the corresponding thick portion 45. The distance between the outer circumferential surface 23*a* of the outer circumferential wall 23 and the inner circumferential surface 42*b* of the first circumferential wall 42 in each distal recess 82*b* is referred to as a third distance. The first distance is equal to the second distance, and the third distance is greater than the first distance and the second distance. That is, the distal recess 82*b* is recessed inward in the radial direction D from the first recess 81 and the basal recess 82*a*.

As shown in FIGS. 3 and 4, the dimension of the distal recess 82*b* is greater in the circumferential direction of the outer circumferential wall 23 than the dimension of the basal recess 82*a*. The dimension of the distal recess 82*b* in the circumferential direction of the outer circumferential wall 23 is greater than the dimension of the part of each thick portion 45 that protrudes into the intake chamber S4. In addition, the dimension of the distal recess 82*b* is greater in the axial direction A than the dimension of the basal recess 82*a*.

Thus, the connection space S6 between each second recess 82 and the corresponding thick portion 45 is wider than the connection space S6 between each first recess 81 and the corresponding thick portion 45. That is, the connection space S6 between each first recess 81 and the corresponding thick portion 45 is narrower than other connection spaces S6.

Sets of two adjacent intake sub-chambers with one of the second recesses 82 located in between, namely, the first intake sub-chamber S5*a* and the second intake sub-chamber S5*b*, the second intake sub-chamber S5*b* and the third intake sub-chamber S5*c*, the fourth intake sub-chamber S5*d* and the fifth intake sub-chamber S5*e*, and the fifth intake sub-chamber S5*e* and the sixth intake sub-chamber S5*f*, communicate with each other through the connection spaces S6 of the second recesses 82. Sets of two adjacent intake sub-chambers with one of the first recesses 81 located in between, namely, the third intake sub-chamber S5*c* and the fourth intake sub-chamber S5*d*, and the sixth intake sub-chamber S5*f* and the first intake sub-chamber S5*a*, communicate with each other through the connection spaces S6 of the first recesses 81.

The outer circumferential wall 23 includes intake passages 85 serving as communication passages. The intake passages 85 cause the intake chamber S4, which is located on the outer side of the outer circumferential wall 23, and the compression chamber S1, which is located on the inner side of the outer circumferential wall 23, to communicate with each other. Each intake passage 85 extends through the corresponding second recess 82 in the thickness direction. That is, each intake passage 85 opens in the corresponding second recess 82. Thus, the intake passages 85 respectively open in the parts of the outer circumferential surface 23*a* of the outer circumferential wall 23 that are opposed to the thick portions 45.

In this manner, the intake chamber S4 communicates with the outermost circumferential part of the compression chamber S1. The intake passages 85 are arranged in the circumferential direction between the first intake sub-chamber S5*a* and the second intake sub-chamber S5*b*, between the second intake sub-chamber S5*b* and the third intake sub-chamber S5*c*, between the fourth intake sub-chamber S5*d* and the fifth intake sub-chamber S5*e*, and between the fifth intake sub-chamber S5*e* and the sixth intake sub-chamber S5*f*. The intake passages 85 extend in one direction orthogonal to the axial direction A. That is, the intake passages 85 extend in parallel to one another.

As shown in FIG. 2, the area of the intake passage 85 that opens in the second recess 82 opposed to the fifth thick portion 45*e* is smaller than the areas of the intake passages 85 that open in the second recesses 82 opposed to the second thick portion 45*b*, the third thick portion 45*c*, and the sixth thick portion 45*f*. That is, the intake passage 85 that opens toward the fifth thick portion 45*e* is narrower than the intake passages 85 that open toward the second thick portion 45*b*, the third thick portion 45*c*, and the sixth thick portion 45*f*.

The fixed spiral wall 24 of the fixed scroll member 21 is spirally wound in the clockwise direction as viewed from the first side A1 from the position of the fourth thick portion 45*d* located on the inner side in the radial direction toward the center of the fixed base 22 in the radial direction D. That is, the fixed spiral wall 24 is located on the immediately inner side of the part of the outer circumferential wall 23 opposed to the fourth thick portion 45*d*.

A space S1*a* serving as the compression chamber S1 is located on the immediately inner side of the part of the outer circumferential wall 23 opposed to the fifth thick portion 45*e*. The fixed spiral wall 24 is spaced apart from the outer circumferential wall 23 in the radial direction D to configure the space S1*a*. The space S1*a* is narrower than a space Sib located on the immediately inner side of the parts of the outer circumferential wall 23 opposed to the first to third and sixth thick portions 45*a* to 45*c* and 45*f*.

Thus, the intake passages 85 communicating with the space S1*a* have a smaller opening area and are narrower than the intake passages 85 communicating with the space Sib. In other words, the opening areas of the intake passages 85 that open at the parts of the outer circumferential wall 23 having a long distance to the fixed spiral wall 24 are larger than the opening areas of the intake passages 85 that open at the parts of the outer circumferential wall 23 having a short distance to the fixed spiral wall 24.

The operation of the present embodiment will now be described.

In the compressor 10, when the rotation shaft 31 rotates, the driving force produced by the rotation is transmitted to the orbiting scroll member 25 through the eccentric shaft 36 and the bushing 37, thereby causing orbiting motion of the orbiting scroll member 25. That is, the orbiting scroll member 25 orbits about the axis of the rotation shaft 31. This reduces the volume of the compression chamber S1 and thus compresses fluid drawn into the compression chamber S1.

More specifically, the fluid in the compression chamber S1 is spirally delivered from the outer side of the fixed spiral wall 24 and the orbiting spiral wall 27 toward the center while being compressed. The pressure of the fluid tends to be higher on the inner side of the orbiting spiral wall 27 in the radial direction D than on the outer side of the orbiting spiral wall 27 in the radial direction D. The compressed fluid is discharged from the discharge port 22*a* to the discharge chamber S2. The fluid in the discharge chamber S2 flows into the oil separator 43 and is then discharged out of the discharge port lib.

As shown in FIG. 4, streams of fluid that have been drawn in from the suction port 11*a* and have flowed into the first accommodation space 70 flow through the suction passages 56 into the first to sixth intake sub-chambers S5*a* to S5*f*. As shown by arrows F in FIG. 4, the streams of fluids that have flowed into the first to sixth intake sub-chambers S5*a* to S5*f* flow into the connection spaces S6 located between the second recesses 82 and the thick portions 45. Then, the streams of fluids flow into the intake passages 85 of the second recesses 82 and are then drawn into the compression chamber S1.

For example, the fluid that has flowed into the first intake sub-chamber S5*a* and the fluid that has flowed into the second intake sub-chamber S5*b* flow into the connection spaces S6 between the second thick portions 45*b* and the second recesses 82 and then flow into the intake passages 85 that open in the second recesses 82. The fluid that has flowed into the second intake sub-chamber S5*b* and the fluid that has flowed into the third intake sub-chamber S5*c* flow into the connection spaces S6 between the third thick portions 45*c* and the second recesses 82 and then flow into the intake passages 85 that open in the second recesses 82.

As shown in FIG. 2, in the compressor 10, the thick portions 45 protrude inward in the radial direction D in the first accommodation space 70. This allows the compressor 10 to be smaller in size than when the entire thick portions 45 protrude outward from the housing 11 in the radial direction D. However, the space of the intake chamber S4 between the first circumferential wall 42 and the outer circumferential wall 23 becomes narrow by the amount by which the thick portions 45 protrude inward in the radial direction D. This limits the flow of fluid between the first to six intake sub-chambers S5*a* to S5*f*.

In the compressor 10 of the present embodiment, the parts of the outer circumferential wall 23 opposed to the thick portions 45 include the second recesses 82, which are recessed inward in the radial direction D. This facilitates the flow of fluid between the first to six intake sub-chambers S5*a* to S5*f*.

In the compressor 10, if the temperature of fluid decreases when the electric motor 30 is not running, the fluid may transition from gas to liquid. The fluid has a larger flow resistance when part of the fluid is liquid than when part of the fluid is gas. Further, oil may remain in the intake chamber S4. Even in such a situation, the compressor 10 of the present embodiment facilitates the flow of fluid in the intake chamber S4.

Hypothetically, the first to sixth intake sub-chambers S5*a* to S5*f* may respectively communicate with the intake passages 85 extending through the outer circumferential wall 23 in the radial direction D. This hypothetical structure facilitates the movement of fluid from the first to sixth intake sub-chambers S5*a* to S5*f* to the compression chamber S1. However, formation of multiple intake passages 85 in the outer circumferential wall 23 may lower the rigidity of the fixed scroll member 21.

When the rigidity of the fixed scroll member 21 is lowered, the pressure of the compressed fluid may warp the fixed base 22 and thus reduce the hermeticity of the compression chamber S1, thereby lowering the compression efficiency. In the compressor 10 of the present embodiment, the intake passages 85 open in the parts of the outer circumferential surface 23*a* of the outer circumferential wall 23 that are opposed to the thick portions 45. That is, one intake passage 85 is arranged for two intake sub-chambers S5. This reduces the number of the intake passages 85 as compared to when six intake passages 85 are arranged in correspondence with the first to sixth intake sub-chambers S5*a* to S5*f*.

The advantages of the present embodiment will now be described.

(1) In the compressor 10, the dimensions of the thick portions 45 of the housing 11 that protrude outward can be shortened. That is, the compressor 10 can be reduced in size. Further, the parts of the fixed scroll member 21 opposed to the thick portions 45 of the outer circumferential wall 23 include the second recesses 82, which are recessed inward in the radial direction D. This allows the space where fluid flows to be defined between the thick portions 45 and the outer circumferential wall 23 of the fixed scroll member 21. This suppresses the obstruction to the flow of fluid in the space in the housing 11.

(2) Each intake passage 85 opens between two of the intake sub-chambers S5 located on the opposite sides of the corresponding thick portion 45 in the circumferential direction. This allows fluid to flow through the opening of the intake passage 85 from the two intake sub-chambers S5 to the space where the fixed spiral wall 24 and the orbiting spiral wall 27 are located. Thus, the number of the intake passages 85 is reduced as compared to when the intake passages 85 are separately arranged in correspondence with the intake sub-chambers S5, which are configured by dividing the intake chamber S4 by the thick portions 45. This limits decreases in the rigidity of the fixed scroll member 21.

(3) Leakage of fluid during compression resulting from deformation of the fixed scroll member 21 is prevented. When fluid is liquid (for example, liquid refrigerant), the resistance is large for the passage of the liquid through the narrow connection spaces S6 between the thick portions 45 and the outer circumferential wall 23. The opening of the intake passages 85 in the connection spaces S6 allows liquid to be discharged with a low resistance while flowing through the compression chamber S1.

(4) The second recesses 82 are respectively opposed to some (four) of multiple (six) thick portions 45. This further facilitates the flow of fluid in the intake chamber S4.

(5) The dimensions of the distal recesses 82*b* are greater in the circumferential direction of the outer circumferential wall 23 than the dimensions of the parts of the thick portions 45 that protrude into the intake chamber S4. This increases the cross-sectional area of each connection space S6 when cut on the plane orthogonal to the circumferential direction of the outer circumferential wall 23.

(6) The opening areas of the intake passages 85 that open at the parts of the outer circumferential wall 23 having a long distance to the fixed spiral wall 24 are larger than the opening areas of the intake passages 85 that open at the parts of the outer circumferential wall 23 having a short distance to the fixed spiral wall 24. This limits unnecessary increases of the intake passages 85 in size and enhances the rigidity of the fixed scroll member 21.

(7) The intake passages 85 extend in parallel to one another. Thus, the intake passages 85 can be easily formed by machining the fixed scroll member 21.

(8) The parts of the outer circumferential wall 23 opposed to the thick portions 45 include both the second recesses 82 and the intake passages 85. This facilitates the flow of fluid in the intake chamber S4, facilitates the flow of fluid to the compression chamber S1, and ensures the rigidity of the fixed scroll member 21, all of which can be achieved in a well-balanced manner.

It should be apparent to those skilled in the art that the present disclosure may be embodied in many other specific forms without departing from the spirit or scope of the disclosure. Particularly, it should be understood that the present disclosure may be embodied in the following forms.

The partition wall including the thick portions 45, that is, the housing member including the first circumferential wall 42, is not limited to the first housing member 40. Instead, the second housing member 50 may include the first circumferential wall 42. As another option, the first circumferential wall 42 may be divided and shared by the first housing member 40 and the second housing member 50.

In the housing 11, the number of the thick portions 45, which serve as fastened portions, may be changed. For example, the number of the thick portions 45 may be one, two, three, four, five, seven or more.

The fixed scroll member 21 may include the second recesses 82 on all of the six parts of the outer circumferential wall 23 opposed to the thick portions 45 or may include the second recesses 82 on one, two, three, four, or five parts of the outer circumferential wall 23 opposed to the thick portions 45. That is, the fixed scroll member 21 may be configured such that at least one of the parts of the outer circumferential wall 23 opposed to the thick portions 45 does not include the second recess 82 and one or more of the parts include the second recesses 82.

The fixed scroll member 21 does not have to be configured such that the first recesses 81 or the second recesses 82 are formed on all the parts of the outer circumferential wall 23 opposed to the thick portions 45. Instead, the fixed scroll member 21 may be configured such that some of the parts of the outer circumferential wall 23 opposed to the thick portions 45 do not include the first recesses 81 or the second recesses 82 and are in contact with the thick portions 45 of the first circumferential wall 42. That is, the fixed scroll member 21 may be configured such that at least one of the parts of the outer circumferential wall 23 opposed to the thick portions 45 does not include a recess and one or more of the parts include the second recesses 82.

In the part of the outer circumferential wall 23 opposed to the first thick portion 45*a* or the fourth thick portion 45*d*, the outer circumferential wall 23 and the thick portions 45 may be in contact with each other.

Each second recess 82 does not have to include the basal recess 82*a*. Instead, the entire second recess 82 may be configured by the distal recess 82*b*. Further, in addition to the basal recess 82*a* and the distal recess 82*b*, the second recess 82 may include one or more recesses that differ from the recesses 82*a* and 82*b* in at least one of the length in the circumferential direction and the depth in the radial direction D.

The first distance, the second distance, and the third distance do not need to have the relationship described in the above-described embodiment. For example, the first distance may differ from the second distance, the second distance may be greater than the third distance, and the first, second, and third distances may be the same.

The intake passages 85 do not have to be arranged in parallel to one another. Instead, the intake passages 85 may extend radially in the radial direction D.

The intake passages 85 do not have to open in all the second recesses 82 and may open in some of the second recesses 82, i.e., one or more of the second recesses 82.

It is preferred that at least one intake passage 85 be arranged for two intake sub-chambers S5 arranged in the circumferential direction of the outer circumferential wall 23. For example, in the above-described embodiment, it is preferred that at least three intake passages 85 be arranged for six intake sub-chambers S5. Instead, for example, each one of the intake passages 85 may be arranged for a set of the first to third intake sub-chambers S5*a* to S5*c* and for a set of the fourth to sixth intake sub-chambers S5*d* to S5*f*.

The fasteners that fasten the first housing member 40 and the second housing member 50 to each other are not limited to the bolts 12. Instead, the fasteners may be, for example, rivets. The bolt through-holes 47 and 55 may be grooved portions that communicate with the outer side in the radial direction D.

The first housing member 40 and the second housing member 50 may include a recess and a projection configured to be positioned with respect to each other.

The intake passages 85 do not have to open in the parts of the outer circumferential surface 23*a* of the outer circumferential wall 23 opposed to the thick portions 45. Some or all of the intake passages 85 may open in the parts of the outer circumferential surface 23*a* of the outer circumferential wall 23 that are not opposed to the thick portions 45.

The housing 11 does not have to have a circular cross section orthogonal to the axial direction. For example, the housing 11 may have a polygonal cross section orthogonal to the axial direction. The shapes of the first housing member 40, the second housing member 50, and the third housing member 60 may be changed.

The compressor 10 does not have to include the electric motor 30, which is one example of a driving mechanism. Instead, the compressor 10 may use an engine, which is one example of a driving mechanism, to rotate the rotation shaft 31.

The compressor 10 may be configured without a driving mechanism such that the compression mechanism 20 is driven by a driving force from the outside. In this case, the compressor 10 does not have to include the third housing member 60.

The compressor 10 does not have to be used for an onboard air conditioner. For example, when the vehicle is a fuel cell vehicle, the compressor 10 may be used for an air supplying device that supplies the fuel cells with air. That is, the fluid to be compressed is not limited to refrigerant and may be, for example, air. Additionally, the compressor 10 does not have to be installed in a vehicle.

Therefore, the present examples and embodiments are to be considered as illustrative and not restrictive and the disclosure is not to be limited to the details given herein, but may be modified within the scope and equivalence of the appended claims.

The invention claimed is:

1. A scroll compressor comprising:

a housing having a suction port and a discharge port; and a compression mechanism accommodated in the housing, wherein the compression mechanism is configured to compress fluid drawn in from the suction port and discharge the fluid out of the discharge port, wherein the housing includes:

a first housing member having an annular partition wall, and a second housing member fastened to the first housing member by a fastener, wherein the first housing member and the second housing member internally define a space, the annular partition wall includes a fastened portion through which the fastener is inserted, wherein the fastened portion is thicker than other portions in a circumferential direction of the partition wall, the fastened portion protrudes inward in a radial direction in the space, the compression mechanism includes:

a fixed scroll member accommodated in the space, and an orbiting scroll member accommodated in the space, wherein the orbiting scroll member is engaged with the fixed scroll member to define a compression chamber, the fixed scroll member includes:

a fixed spiral wall extending spirally, and an outer circumferential wall that surrounds the fixed spiral wall, the outer circumferential wall includes a recess recessed inward in the radial direction, wherein the recess is located at a part of the outer circumferential wall opposed to the fastened portion in the radial direction, a dimension of the recess in the circumferential direction is greater than a dimension of a part of the fastened portion in the circumferential direction that protrudes into the space;

the recess extends from a distal end of a first side of the outer circumferential wall toward a basal end of a second side of the outer circumferential wall, the recess includes a basal recess located on the second side of the outer circumferential wall, and a distal recess located on the first side of the outer circumferential wall, and a communication passage that opens in the distal recess and causes an outer side and an inner side of the outer circumferential wall to communicate with each other, the distal recess is deeper in the radial direction than the basal recess, and a part of the fastened portion is in the recess.

2. The scroll compressor according to claim 1, wherein the fastened portion comprises a plurality of fastened portions arranged in the circumferential direction of the annular partition wall of the first housing member, and the recess is arranged in correspondence with at least one of the plurality of fastened portions.

3. The scroll compressor according to claim 1, wherein the fastened portion comprises a plurality of fastened portions arranged in the circumferential direction of the annular partition wail of the first housing member, the recess comprises a plurality of recesses, where at least two of the plurality of recesses correspond with a respective at least two of the plurality of fastened portions, and the communication passage comprises a plurality of communication passages, a respective communication passage of the plurality of communication passages being formed in at least two of the plurality of recesses.

4. The scroll compressor according to claim 1, wherein the fastened portion comprises a plurality of fastened portions incorporated in the first housing member, the recess comprises a plurality of recesses of the outer circumferential wall, the plurality of recesses being opposed to the respective plurality of fastened portions, and at least parts of the outer circumferential wall do not include the recess.

* * * * *